US006712044B1

(12) United States Patent
Rembold et al.

(10) Patent No.: US 6,712,044 B1
(45) Date of Patent: Mar. 30, 2004

(54) FUEL SUPPLY SYSTEM FOR AN INTERNAL COMBUSTION ENGINE, ESPECIALLY A MOTOR VEHICLE

(75) Inventors: Helmut Rembold, Stuttgart (DE); Ferdinand Grob, Besigheim (DE); Hartmut Bauer, Gerlngen (DE); Uwe Maienberg, Leonberg (DE); Klaus Scherrbacher, Reichenbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/890,350

(22) PCT Filed: Jan. 27, 2000

(86) PCT No.: PCT/DE00/00229

§ 371 (c)(1),
(2), (4) Date: Aug. 23, 2001

(87) PCT Pub. No.: WO00/45047

PCT Pub. Date: Aug. 3, 2000

(30) Foreign Application Priority Data

Jan. 28, 1999 (DE) ..... 199 03 272

(51) Int. Cl.[7] ..... F02M 41/00
(52) U.S. Cl. ..... 123/456; 123/458; 123/179.17
(58) Field of Search ..... 123/456, 447, 123/497, 457, 458, 506, 179.17

(56) References Cited

U.S. PATENT DOCUMENTS

| | | | | |
|---|---|---|---|---|
| 5,598,817 A | * | 2/1997 | Igarashi et al. | 123/179.17 |
| 5,758,622 A | * | 6/1998 | Rembold et al. | 123/456 |
| 5,775,304 A | * | 7/1998 | Kono et al. | 123/497 |
| 6,021,763 A | * | 2/2000 | Yoshihara et al. | 123/516 |

FOREIGN PATENT DOCUMENTS

| | | | |
|---|---|---|---|
| DE | 3304605 | * | 8/1983 |
| DE | 33 04 605 | | 8/1983 |
| DE | 197 53 155 | | 6/1999 |
| FR | 2763100 | * | 11/1998 |
| WO | WO 97/08456 | | 3/1997 |

OTHER PUBLICATIONS

"Hochdruckeinspritzung und abgasrezirkulation im kleinen, schnellaufenden Dieselmotor mit direktor Einspritzung", W. Schneider et al, Motortechnische Zeitschrift 54 (1993) 11, pp. 588–599.

"New Electronically Controlled Fuel Injection System ECD–U2 for Clean Diesel Engines", T. Omori et al, Conference "Engine and Environment" '92, Nippondenso Co., Ltd, pp. 1–17.

"Benzineinspritzung elektronisch gesteuert", Bosch Technische Unterrichtung, (1972).

"Das Common–Rail–Einspritzysystem–ein neues Kapitel der Dieseleinspritztechnik", K. Hoffmann et al, Motortechnische Zeitschrift 58 (1997) 10, pp. 572–582.

* cited by examiner

*Primary Examiner*—Mahmoud Gimie
(74) *Attorney, Agent, or Firm*—Walter Ottesen

(57) ABSTRACT

A method is provided for starting an internal combustion engine which includes a starter, an ignition, pressure store and injection valves for injecting fuel directly into the engine. An electrical high pressure pump is connected to an electrical fuel pump downstream thereof for pumping the fuel into the pressure store. The electrical fuel pump and the electrical high pressure pump are first switched on together with the ignition in order to generate a pressure in the pressure store adequate for the injection of the fuel. Then, the starter is switched on after a time duration after the electric fuel pump and the electrical high pressure fuel pump are switched on.

5 Claims, 2 Drawing Sheets

FUEL SUPPLY SYSTEM FOR AN INTERNAL COMBUSTION ENGINE, ESPECIALLY A MOTOR VEHICLE

FIELD OF INVENTION

The invention relates to a method for operating a fuel supply system for an internal combustion engine, especially of a motor vehicle wherein the fuel is pumped by a pump into a pressure store and is injected directly into the engine via injection valves. Furthermore, the invention relates to a fuel supply system for an internal combustion engine, especially of a motor vehicle having a pressure store and a pump with which fuel can be supplied to the pressure store and having injection valves with which fuel can be injected directly into the engine.

BACKGROUND OF THE INVENTION

Ever higher requirements are imposed on an internal combustion engine such as of a motor vehicle with respect to a reduction of the fuel consumption and the generated exhaust gases while simultaneously increasing the desired power. For this purpose, modern engines are provided with a fuel supply system in which the supply of fuel into the combustion chamber of the engine is controlled (open loop and/or closed loop) electronically, especially by a computer-supported control apparatus.

In the so-called gasoline direct injection, it is necessary that the fuel is injected into the combustion chamber under pressure. For this purpose, a pressure store is provided into which the fuel is pumped by a pump and is placed under a high pressure. From there, the fuel is injected into the combustion chambers of the engine via injection valves.

When starting the internal combustion engine, the above-mentioned high pressure is mostly not available or is at least not immediately available. The starting of the engine must therefore be separately controlled (open loop and/or closed loop). In this context, the already mentioned peripheral conditions, such as reduced toxic substance discharge, are to be satisfied.

SUMMARY OF THE INVENTION

It is an object of the invention to provide a method for operating a fuel supply system for an internal combustion engine with which a starting of the engine as optimal as possible can be carried out.

This object is achieved in a method and/or a fuel supply system of the type mentioned initially herein in accordance with the invention in that a pressure, which is adequate for the injection, is generated in the pressure store by the pump within a short time duration, especially within a few revolutions of the engine.

In this way, it is possible that no complex controls (open loop and/or closed loop) are required for the starting of the engine. In lieu thereof, the engine can be controlled (open loop and/or closed loop) essentially immediately in correspondence to its normal operation. The invention therefore makes possible a starting of the engine under conditions which correspond to the normal operation of the engine.

In an advantageous further embodiment of the invention, the adequate pressure is generated within a few revolutions after the start of the engine. In this way, the starting of the engine is further improved by means of the control (open loop and/or closed loop) in correspondence to the normal operation.

In a first advantageous embodiment of the invention, the pump is coupled to the engine and the engine is started at an rpm in the region of the idle rpm. For this purpose, the starter is preferably configured as a so-called starter-generator. Because the idle rpm is reached rapidly, the pressure, which is required for the normal operation, is almost immediately available in the pressure store.

In a second advantageous embodiment of the invention, an electrical pump is used for generating the pressure. This electrical pump can preferably be switched on together with the ignition and therefore preferably in advance of the starter. In this way, the pressure in the pressure store, which is required for the normal operation, can be built up by the electrical pump up to the actual starting operation.

Of special significance is the realization of the method of the invention in the form of a control element which is provided for a control apparatus of an internal combustion engine, especially of a motor vehicle. A program is stored on the control element which can be run on a computing apparatus, especially on a microprocessor, and is suitable for carrying out the method of the invention. In this case, the invention is realized by a program stored on the control element so that this control element, which is provided with the program, defines the invention in the same manner as the method for which the program is suitable for carrying out. As a control element, especially an electrical storage medium can be used, for example, a read-only-memory.

Further features, application possibilities and advantages of the invention result from the description of the embodiments of the invention which follow and which are shown in the drawing. All described or illustrated features form the subject matter of the invention by themselves or in any desired combination independently of their summary in the patent claims or their dependency as well independently of their formulation or illustration in the description or in the drawing.

BRIEF DESCRIPTION OF THE DRAWINGS

The invention will now be described with respect to the drawings wherein.

DESCRIPTION OF THE PREFERRED EMBODIMENTS OF THE INVENTION

Figure 1:
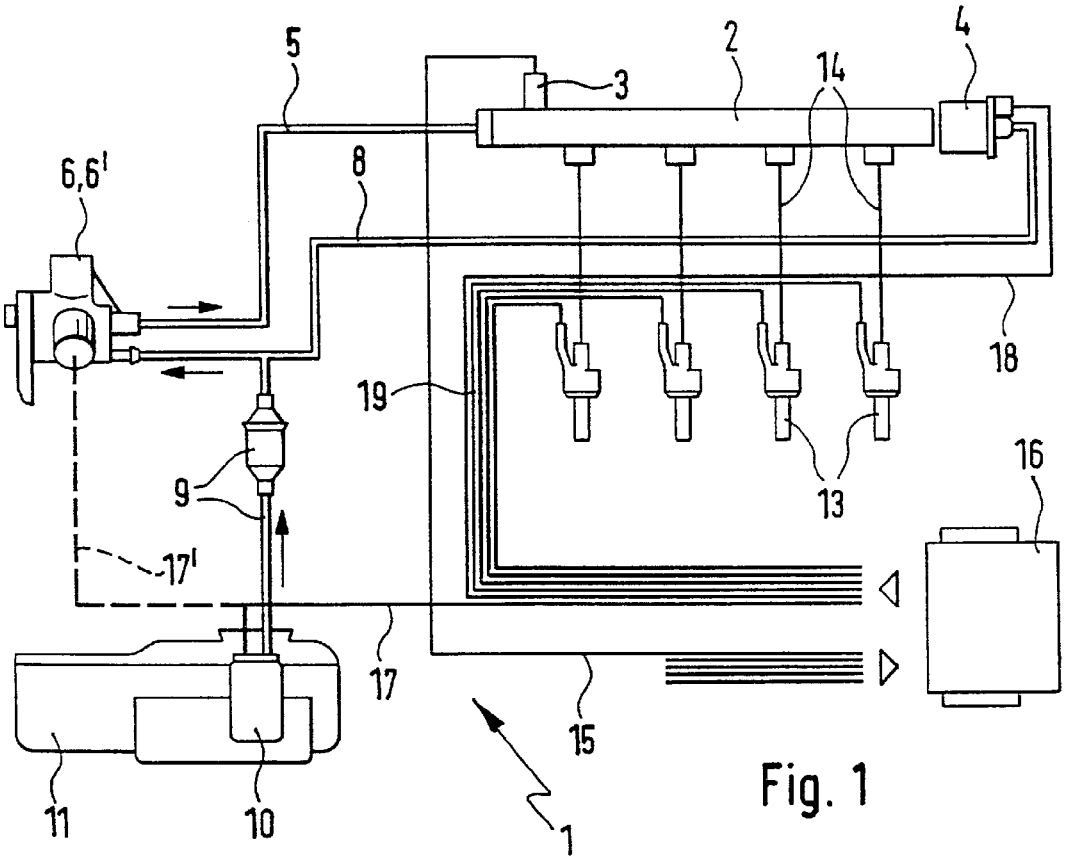
FIG. 1 shows a schematic illustration of an embodiment of a fuel supply system according to the invention; and, FIG. 2 shows a schematic time diagram for an embodiment of a method of the invention for operating the fuel supply system of FIG. 1.

In FIG. 1, a fuel supply system 1 is shown which is provided for use in an internal combustion engine of a motor vehicle. The fuel supply system 1 is a so-called common rail system which is utilized especially in an internal combustion engine having gasoline direct injection.

The fuel supply system 1 includes a pressure store 2 which is provided with a pressure sensor 3 and a pressure control valve (DSV) 4. The pressure store 2 is connected via a pressure line 5 to a mechanical high pressure pump 6. The high pressure pump 6 is coupled to the internal combustion engine and generates a high pressure when the engine rotates. The high pressure pump 6 is connected via a pressure line 8 to the pressure control valve 4. The pressure control valve 4, and therefore also the high pressure pump 6, is connected to an electrical fuel pump 10 via a pressure line 9 and a filter. The fuel pump 10 is suitable for drawing fuel from a fuel tank 11. The electrical fuel pump 10 generates a pressure as soon as a voltage is supplied thereto. This is at least the case for a short time when the ignition of the motor vehicle is switched on.

The fuel supply system 1 includes four injection valves 13 which are connected via pressure lines 14 to the pressure store 2. The injection valves 13 are suited to inject fuel into corresponding combustion chambers of the engine.

The pressure sensor 3 is connected to a control apparatus 16 via a signal line 15. Furthermore, a plurality of other signal lines are connected as input lines to the control apparatus 16. The fuel pump 10 is connected to the control apparatus 16 via a signal line 17 and the pressure control valve 4 is connected to the control apparatus 16 via a signal line 18. Furthermore, the injection valves 13 are connected via signal lines 19 to the control apparatus 16.

In normal operation of the engine, the fuel is pumped from the fuel tank 11 to the high pressure pump 6 by the fuel pump 10. With the aid of the high pressure pump 6, a pressure is generated in the pressure store 2 which is measured by the pressure sensor 3 and can be controlled (open loop and/or closed loop) to a desired value by a corresponding actuation of the pressure control valve 4 and/or the control of the fuel pump 10. The fuel is then injected into the combustion chambers of the engine via the injection valves 13.

The pressure in the pressure store 2 is, inter alia, essential for the dimensioning of the fuel quantity to be injected into the respective combustion chambers. The greater the pressure in the pressure store 2, the more fuel is injected into the combustion chamber during the same injection time. This pressure in the pressure store 2 can be controlled (open loop and/or closed loop) by the control apparatus 16.

For this purpose, the control apparatus 16 controls, for example, the pressure control valve 4 into its closed state so that the high pressure pump 6 and the fuel pump 10 generate an ever increasing pressure in the pressure store 2. This increasing pressure can be measured by the pressure sensor 3.

Likewise, it is possible that the control apparatus 16 increases the rpm of the fuel pump 10 which leads to an increased pumping capacity of the fuel pump 10 and has, as a consequence, an increased pressure in the pressure store 2. The increase of this pressure and therefore the increase of the rpm or the pumping capacity of the fuel pump 10 can likewise be determined via the pressure sensor 3.

A plurality of special peripheral conditions must be considered for starting the internal combustion engine. This is carried out by the control apparatus 16 via the following method shown in FIG. 2. The individual steps of the method can, for example, be realized in the control apparatus 16 as modules of a program or the like.

Figure 2:
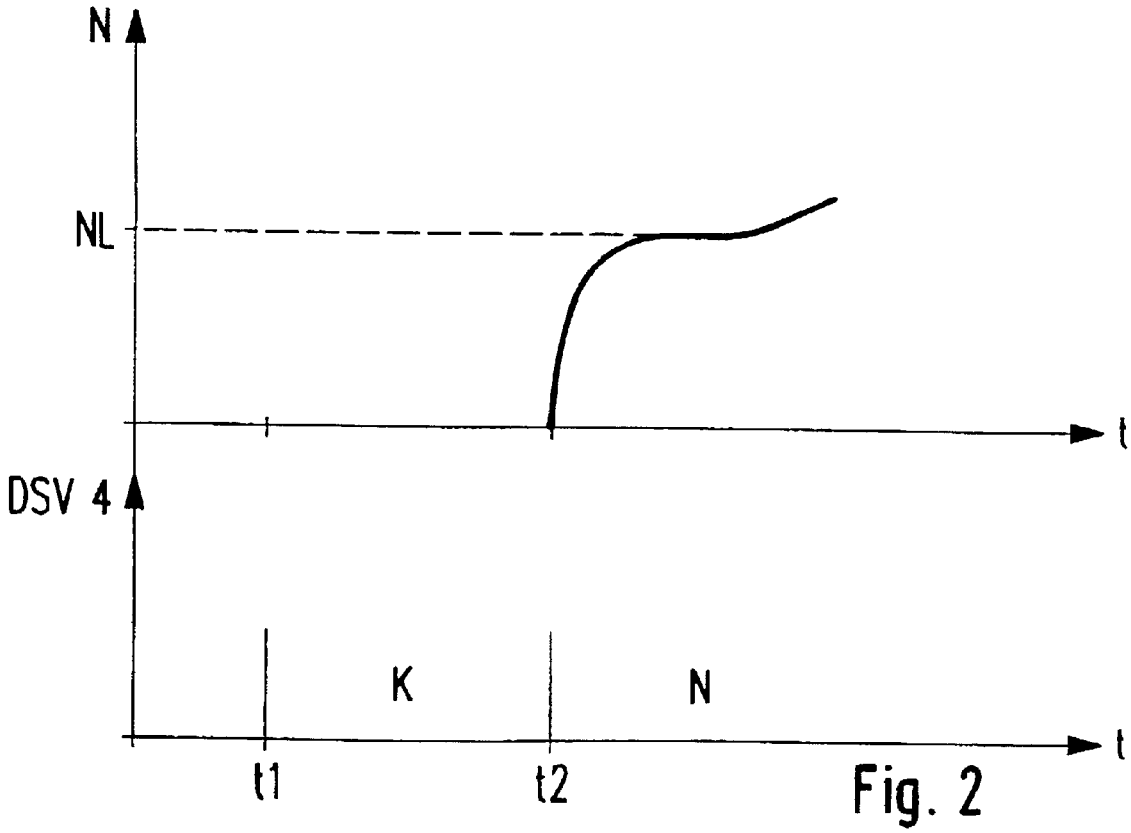

In advance of time point t1 shown in FIG. 2, the ignition of the engine is not yet switched on and the starter of the engine is not yet activated.

The ignition of the engine is switched on at time point t1 but the starter does not yet carry out any rotational movement. This means that a user of the vehicle wants to start the engine but the engine does not yet carry out any rotational movement. Starting from the time point t1 until time point t2, the ignition remains switched on and the starter is not yet actuated. The pressure control valve 4 is or remains closed in the time interval between the time points t1 and t2. For this purpose, a preferably constant pulse-duty factor K is transmitted via the signal line 18.

At time point t2 of FIG. 2, the starter imparts a rotational movement to the engine. The starter is preferably a so-called starter-generator or the like. The rpm N of the engine becomes unequal to zero and increases rapidly. Within a short time duration, preferably within a few revolutions of the engine, the starter reaches approximately the idle rpm NL of the engine.

After the time point t2, a pulse-duty factor N is transmitted via the signal line 18 to the pressure control valve 4 which is generated in correspondence to a normal operation of the engine. This normal operation has already been described. A high pressure is immediately generated in the pressure store 2 because of the idle rpm of the engine which is already available after a few rotations of the starter. With this high pressure, the control (open loop and/or closed loop) of the engine leads to a start of the engine in correspondence to the normal operation.

The rpm N of the engine increases further as soon as the engine carries out a rotational movement on its own force because of the executed injections of fuel into the combustion chambers thereof. The engine is started.

In total, the following starting operation of the engine results.

In advance of time point t1, that is, in advance of the switch-on of the ignition and in advance of starting the starter, the pressure control valve 4 can be opened or closed in any condition.

The control valve 4 is closed at time point t1, that is, as soon as the ignition of the vehicle is switched on. This state is maintained up to time point t2, that is, until the starter is actuated. In this way, the pressure in the pressure store 2 is dependent in this time span on the pressure, which is present in advance of time point t1, as well as on the pressure which is generated by the electric fuel pump 10.

The pressure control valve 4 is controlled (open loop and/or closed loop) in correspondence to a normal operation of the engine starting at time point t2, that is, when the ignition is switched on and when the starter is rotating. The high pressure pump 6 comes to full operation essentially immediately because of the idle rpm of the starter. In this way, the pressure in the pressure store 2 is substantially dependent upon the high pressure pump 6 starting at time point t2. The pressure in the pressure store 2 thereby almost immediately reaches its value present during normal operation so that the pressure, which is required for the injection of fuel via the injection valves 13 into the combustion chambers of the engine, is likewise almost immediately available.

In an alternate embodiment of the invention, there is no mechanical high pressure pump 6 present which is coupled to the engine; instead, an electrical high pressure pump 6' is present. This electrical high pressure pump 6' is connected to the control apparatus 16 via the signal line 17' shown in phantom in FIG. 1.

At time point t1 of FIG. 2, not only the electrical fuel pump 10 is switched on but also the electrical high pressure pump 6'. The pressure control valve 4 is closed via the pulse-duty factor K. In this way, a pressure is built up in the pressure store 2 by the high pressure pump 6'. The electrical high pressure pump 6' is so configured and dimensioned that, within a short time duration (preferably within a few revolutions of the engine), pressure is already available in the pressure store 2 which is adequate for the injection of fuel into the combustion chambers of the engine.

If the starter is switched on at time point t2, that is, after a certain time duration after time point t1, then the pressure is present in the pressure store 2 which is required for the normal operation. The pressure control valve 4 is thereby controlled (open loop and/or closed loop) at the pulse-duty factor N corresponding to the normal operation.

Even when the starter is switched on together with the ignition of the vehicle (that is, even when the time points t1 and t2 are coincident), the pressure in the pressure store 2 already reaches the value present during normal operation after only a few revolutions of the engine. The engine can thereby be operated in normal operation also in this case starting at time point t2.

What is claimed is:

1. A method for starting an internal combustion engine including an internal combustion engine of a motor vehicle, the engine including a starter, an ignition, pressure store and injection valves for injecting fuel directly into the engine, the method comprising the steps of:

providing an electrical fuel pump and an electrical high pressure pump connected to said electrical fuel pump downstream thereof for pumping the fuel into said pressure store;

first switching said electrical fuel pump and said electrical high pressure pump on together with said ignition in order to generate a pressure in said pressure store adequate for the injection of the fuel; and, then, switching said starter on after a time duration after said electric fuel pump and said electrical high pressure fuel pump are switched on.

2. The method of claim 1, wherein the adequate pressure is generated immediately after the start of the engine.

3. A computer program product having a program, the computer program product comprising:

a carrier readable by a computer and said program being stored on said carrier; and, when executed by the computer, said program being suitable for carrying out a method for starting an internal combustion engine including a starter, an internal combustion engine of a motor vehicle, the engine including an ignition, pressure store and injection valves for injecting fuel directly into the engine, the method including the steps of:

providing an electrical fuel pump and an electrical high pressure pump connected to said electrical fuel pump downstream thereof for pumping the fuel into said pressure store;

first switching said electrical fuel pump and said electrical high pressure pump on together with said ignition in order to generate a pressure in said pressure store adequate for the injection of the fuel; and, then, switching said starter on after a time duration after said electric fuel pump and said electrical high pressure fuel pump are switched on.

4. The computer program product of claim 3, wherein said carrier is a read-only-memory.

5. A fuel supply system for an internal combustion engine including an engine of a motor vehicle, the engine including a starter and an ignition, the fuel supply system comprising:

a pressure store;

an electrical fuel pump and an electrical high pressure pump connected to said electrical fuel pump downstream thereof for pumping fuel into said pressure store;

injection valves connected to said pressure store for injecting the fuel directly into said engine; and, means for first switching on said electrical fuel pump and said electrical high pressure pump together with said ignition for generating pressure in said pressure store adequate for injecting the fuel via said injection valves; and, means for then switching said starter on after a time duration after said electric fuel pump and said electrical high pressure fuel pump are switched on.

* * * * *